US010300693B2

(12) United States Patent
Gomez et al.

(10) Patent No.: US 10,300,693 B2
(45) **Date of Patent: *May 28, 2019**

(54) PRINTHEAD DROP DETECTORS

(71) Applicants: Hewlett-Packard Development Company, L.P., Houston, TX (US); Francisco Gomez, Sant Cugat del Valles (ES); Jose Francisco Bravo de Vega, Sant Cugat del Valles (ES); Jordi Bas, Sant Cugat del Valles (ES)

(72) Inventors: Francisco Gomez, Sant Cugat del Valles (ES); Jose Francisco Bravo de Vega, Sant Cugat del Valles (ES); Jordi Bas, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/569,913

(22) PCT Filed: Jul. 2, 2015

(86) PCT No.: PCT/EP2015/065126
§ 371 (c)(1),
(2) Date: Oct. 27, 2017

(87) PCT Pub. No.: WO2017/001021
PCT Pub. Date: Jan. 5, 2017

(65) Prior Publication Data

US 2018/0111367 A1 Apr. 26, 2018

(51) Int. Cl.

| | |
|---|---|
| ***B41J 2/045*** | (2006.01) |
| ***B41J 2/125*** | (2006.01) |
| ***B41J 2/21*** | (2006.01) |

(52) U.S. Cl.
CPC ..... *B41J 2/0456* (2013.01); *B41J 2/04586* (2013.01); *B41J 2/125* (2013.01); *B41J 2/2142* (2013.01)

(58) Field of Classification Search
CPC ..... B41J 2/0456; B41J 2/04586; B41J 2/125; B41J 2/2142
See application file for complete search history.

(56) References Cited

U.S. PATENT DOCUMENTS

| | | |
|---|---|---|
| 4,315,147 A | 2/1982 | Harmer et al. |
| 4,754,289 A | 6/1988 | Kudo |

(Continued)

FOREIGN PATENT DOCUMENTS

| | | |
|---|---|---|
| CN | 102653179 | 9/2012 |
| CN | 103459158 | 12/2013 |
| WO | WO-2014092678 | 6/2014 |

OTHER PUBLICATIONS

International Searching Authority. ISA/EP. International Search Report. Application No. EP/2015/065126, dated Mar. 29, 2016. 4 pages.

(Continued)

*Primary Examiner* — Sharon A. Polk
(74) *Attorney, Agent, or Firm* — HP Inc. Patent Department

(57) ABSTRACT

In some examples, a printhead drop detector comprises a plurality of drop detection units. Each drop detection unit may comprise a radiation source and radiation detector and may be to detect a drop passing through a sampling volume between the radiation source and the radiation detector. A radiation detector of a first drop detection unit and a radiation source of a second drop detection unit is arranged on a first side of the sampling volume; and a radiation source of the first drop detection unit and a radiation detector of the (Continued)

second drop detection unit is arranged on the second side of the sampling volume.

15 Claims, 2 Drawing Sheets

(56) References Cited

U.S. PATENT DOCUMENTS

| | | | |
|---|---|---|---|
| 5,350,929 | A | 9/1994 | Meyer et al. |
| 5,430,306 | A | 7/1995 | Ix |
| 6,350,006 | B1 | 2/2002 | Muller et al. |
| 6,513,900 | B2 | 2/2003 | Endo et al. |
| 6,648,444 | B2 | 11/2003 | Valero et al. |
| 7,815,280 | B2 | 10/2010 | Hayashi et al. |
| 8,419,159 | B2 | 4/2013 | Govyadinov et al. |
| 8,449,068 | B2 | 5/2013 | Govyadinov |
| 8,529,011 | B2 | 9/2013 | Govyadinov |
| 9,056,465 | B2 | 6/2015 | Massen |
| 9,268,023 | B2 | 2/2016 | Garay et al. |
| 9,931,839 | B1 * | 4/2018 | Bravo de Vega ..... G01N 21/47 |
| 2004/0119779 | A1 | 6/2004 | Elgee |
| 2007/0024658 | A1 | 2/2007 | Diol et al. |
| 2013/0293625 | A1 | 11/2013 | Massen |
| 2014/0078213 | A1 | 3/2014 | Govyadinov et al. |

OTHER PUBLICATIONS

Thurow, K. et al., "An Optical Approach for the Determination of Droplet Volumes in Nanodispensing", Feb. 10, 2009. Journal of Automated Methods and Management in Chemistry, vol. 2009, Article ID 198732, 10 pages.

Trondle, J. et al., "Non-contact Optical Sensor to Detect Free Flying Droplets in the Nanolitre Range", Feb. 11, 2010. Available online at: https://www.imtek.de/data/lehrstuehle/app/dokumente/publikationen/publpdf2010/troendle-non-contact-optical-sensor.pdf.

* cited by examiner

PRINTHEAD DROP DETECTORS

BACKGROUND

Some print apparatus disperse print materials such as coloring agent, for example comprising a dye or colorant, from a printhead. An example printhead includes a set of nozzles and a mechanism for ejecting a selected agent as a fluid, for example a liquid, through a nozzle. In such examples, a drop detector may be used to detect whether drops are being ejected from individual nozzles of a printhead. For example, a drop detector may be used to determine whether any of the nozzles are clogged and would benefit from cleaning or having some other maintenance operation performed thereon.

BRIEF DESCRIPTION OF DRAWINGS

Examples will now be described with reference to the accompanying drawings, in which.

DETAILED DESCRIPTION

Figure 1A:
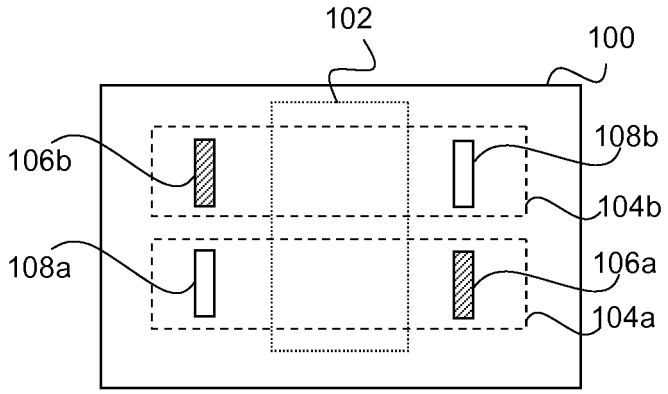
FIGS. 1*a* and 1*b* are a simplified schematic of an example of a drop detector.
Figure 1B:
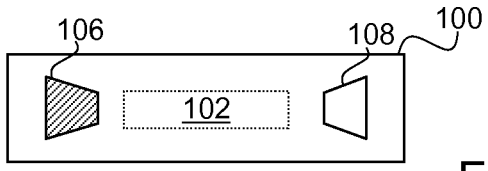

FIGS. 1*a* and 1*b* show, respectively, a top view and a side view of an example of a printhead drop detector 100. The printhead drop detector 100 comprises a plurality of drop detection units 104*a, b*. Each drop detection unit 104*a, b* comprises respective radiation sources 106*a, b* and respective radiation detectors 108*a, b*. The drop detection units 104 are to detect a drop of fluid (which may be, for example a print material such as an ink, coating or other print material) passing through a sampling volume 102 defined between the radiation source 106 and the radiation detector 108 of a unit 104. For example, if the radiation source 106 of a unit 102 is emitting optical radiation (i.e. light, which may in some examples be red light), the arrangement may be such that this light is incident on the radiation detector 108 of the unit 102. A drop passing therebetween creates a shadow and the intensity of light detected by the radiation detector 108 decreases, allowing the presence of a drop to be detected.

While the term 'drop detection unit' is used herein, this may not describe a separate or separable component, and instead may describe a functional pairing. The source 106 and radiation detector 108 of a drop detection unit 104 may therefore considered to be paired, forming an operative rather than structural unit.

As is shown in FIG. 1*a*, a radiation detector 108*a* of a first drop detection unit 104*a* and a radiation source 106*b* of a second drop detection unit 104*b* are arranged on the first side of the sampling volume 102. A radiation source 106*a* of the first drop detection unit 104*a* and a radiation detector 108*b* of the second drop detection unit 104*b* are arranged on the second side (which is opposed to the first side) of the sampling volume 102.

In some examples, the radiation sources 106 may comprise at least one light source, for example an LED (Light Emitting Diode), and/or the radiation detectors 108 may comprise at least one photodetector, for example a photodiode.

Figure 2:
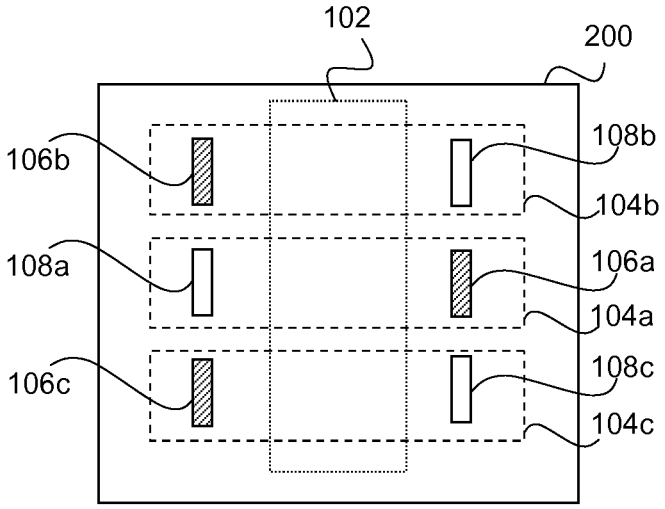
FIG. 2 is a simplified schematic of another example of a drop detector.

FIG. 2 shows another example of a printhead drop detector 200. This example is similar to the example of FIG. 1 (and like parts are labelled with like numbers) but comprises an additional drop detection unit 104*c* comprising a radiation source 106*c* and a radiation detector 108*c*.

As is shown in FIG. 2, the radiation detector 108*a* of a first drop detection unit 104*a* and the radiation source 106*b, c* of the second and third drop detection unit 104*b, c* are arranged on the first side of the sampling volume 102; and the radiation source 106*a* of the first drop detection unit 104*a* and the radiation detector 108*b, c* of the second and third drop detection units 104*b, c* are arranged on the second side of the sampling volume 102. The first drop detection unit 104*a* is arranged between the second 104*b* and third 104*c* drop detection units.

In the examples of FIGS. 1 and 2, radiation detectors 108 and radiation sources 106 on each side of the sampling volume 102 are arranged such that no radiation detector 108 is adjacent to another radiation detector 108, and a radiation source 106 is not adjacent to another radiation source 106. In other words, the arrangement comprises, on opposed sides of the sampling volume 102, alternating radiation detectors 108 and radiation sources 106. The arrangement is such that there is a first row of alternating radiation sources 106, or emitters, and radiation detectors 108 or receiver and second row of alternating radiation emitters/sources and detectors/receivers. Each emitter 106 of the first row is to emit radiation to be received by an associated radiation detector 108 (in the example of FIG. 1, the detector of the same drop detection unit 104) of the second row, and each emitter 106 of the second row is to emit radiation to be received by an associated radiation detector 108 of the first row.

Light, when emitted from a source or an aperture, tends to spread in an effect termed dispersion. While dispersion is less apparent for certain highly directional radiation sources, such as lasers, these tend to be expensive. The light from one source 106 may be incident not just on the associated radiation detector 108, but also on a region around that radiation detector 108. Therefore, care should be taken in designing a drop detector such that the light from sources of other units 104 incident on a radiation detector of a particular unit is not of a sufficient level that it could cause a false negative. A 'false negative' result is seen when the intensity of light at a radiation detector leads to a conclusion that there is no drop when in fact a drop has been ejected: if light of sufficient intensity is received, a drop may be assumed to be absent, even when that light is received from the radiation source of another unit.

If, for example, in an alternative arrangement to that shown in FIGS. 1 and 2, the radiation detectors are all arranged on one side of the sampling volume and the sources on another, design of a drop detector may be such that the separation of radiation detectors is sufficient to ensure that light from sources of other units incident on a radiation detector of a particular unit is not of a sufficient level that it could cause a false negative. Such separation means that the arrangement of detectors is not compact.

In some examples, the separation may be reduced by using more sensitive radiation detectors, although this may add costs. In other examples, light barriers may be used to prevent light from reaching radiation detectors 108 of other units 104, which adds to the complexity of the design. In another example, a lens may be provided to correct of the effects of the dispersion of the beam, but this adds costs and complexity to a drop detector.

In the examples of FIGS. 1 and 2, however, because the radiation detectors 108 and sources 106 are arranged alternately, the units 104 may be closely packed without the need for any additional light blocking measures, and the risk of 'false negatives' due to the effects described above is reduced or removed. Each radiation source 106 which separates any two radiation detectors 108 provides detector separation while allowing the footprint of an array of a particular number of drop detection units 104 to be reduced. In other words, arranging the units 104 with alternating orientations reduces any effect of interference from neighboring units 104.

Figure 3:
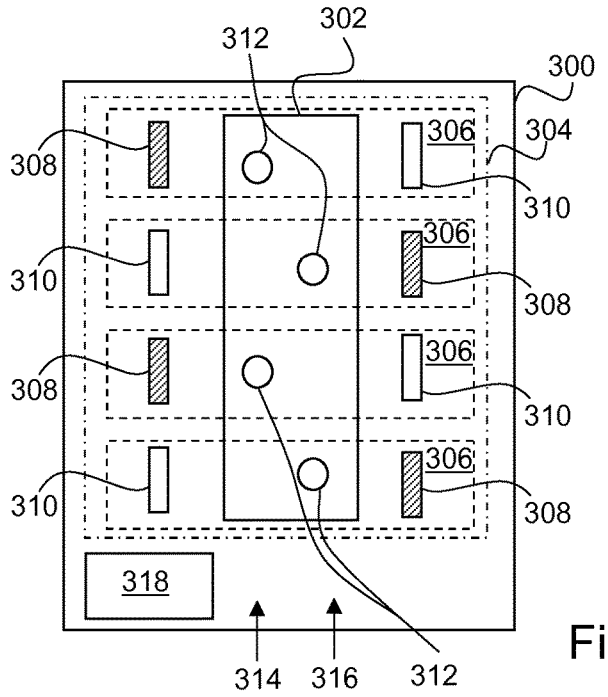
FIG. 3 is a simplified schematic of an example of a print apparatus comprising a drop detector.

FIG. 3 shows an example of a print apparatus 300 shown in plan view, comprising a printhead 302 and a drop detector 304. The printhead 302 is to selectively deliver a print material; and the drop detector 304 is to monitor the ejection of print material from the printhead 302. In one example, the printhead 302 uses inkjet technology to eject print material therefrom. The drop detector 304 comprises a plurality of drop detection units 306, each drop detection unit 306 comprising an emitter 308 (for example, a radiation source) and a receiver 310 (for example a radiation detector). The units 306 are to detect a drop passing through a sampling volume (not marked) between an emitter 308 and a receiver 310, and are arranged such that, on each side of the sampling volume, emitters 308 and receivers 310 are provided alternately. In examples, the drop detector 300 may be a drop detector 100, 200 as described in relation to FIG. 1 or 2.

The printhead 302 comprises a plurality of nozzles 312, the nozzles being arranged in a first column 314 and a second column 316, spaced from the first column 314, wherein the nozzles 312 of the first column 314 are at least substantially parallel to and offset from the nozzles 312 of the second column 316 (i.e. the nozzles 312 are staggered such that, in a first dimension, the nozzles 312 of the first column 314 are interspersed with the nozzles of a second column 316). The columns 314, 316 are also at least substantially parallel to the rows of alternating radiation emitters 308 and receivers 310 arranged on each side of the sampling volume.

Such a distribution of nozzles 312 may be employed in order to improve the smoothness of a printed output. Each unit 306 is associated with one nozzle 312, and may detect the emission (or in some examples, the absence) of a drop from that associated nozzle 312.

It will be noted that each nozzle 312 which is associated with a particular unit 306 is selected from the column 314, 316 which is closer than the other column 314, 316 to the emitter 308. Indeed, in this example, the nozzles 312 are arranged so as to be closer to the emitter 308 of the associated unit 306 than to the receiver 310 of that unit 306.

Due to the effects of dispersion, the cross sectional surface area of a light beam, or a beam of other radiation, leaving the emitter 308 increases with distance from the emitter 308. For some drops, therefore, it may be the case that the drop spans the whole of a beam when the drop falls relatively close to the emitter 308 (i.e. the cross-sectional area of the beam at that point may be smaller than, or comparable to, the size of the drop). However, as the distance from the emitter 308 increases, the whole beam may not be obscured. This means that some light may still reach the receiver 310. Even in examples where the reduction in intensity may be sufficient to determine if a drop is present or not, there may be a reduction in the variability of the intensity detected, and therefore the detection task is harder, more error prone and/or may be implemented by more sensitive detection apparatus.

Moreover, in the manufacture of some LEDs and other light emitters, an excitation pad is arranged in the centre of the emitter. This can create a dark spot in the centre of an emitted beam, which may in some examples become large in the far field. In some examples, such an arrangement of the excitation pad may be provided in an LED which is less directional (and/or less expensive).

The resulting beam for such light sources becomes annular in nature. In some drop detectors, a source and emitter may be separated across a sampling volume by a distance on the order of 30-60 mm. A drop breaking an emitted beam at a distance of around 10-25 mm may substantially block the beam. However, a drop passing through the beam at around 30-60 mm may pass through an upper region of the annulus of light, a region of the dark spot and then through the lower region of the annulus. As a result, a detector signal for a relatively distant drop will show a 'double peak', where the drop breaks the annulus, but the overall signal will be smaller than for a relatively closer drop.

The alternating configuration of drop detection units in the example of FIG. 3 corresponds with the staggered arrangement of nozzles 312, and means that the drops tend to fall through the sampling volume at a distance which is relatively close to the emitter 308. Therefore, compared to an arrangement where the radiation detectors are on one side of the sampling volume, and the emitters on the other side, in which case the drops from one column 314, 316 would fall relatively close to the emitters, and the drops of the other column 314, 316 would fall relatively far from the emitters, all of the units 306 in the example of FIG. 3 are arranged such that a drop will fall relatively close to the emitter 308.

The print apparatus 300 in this example further comprises a processor 318 to receive data from the receiver 310 and to determine a performance indication for the printhead 302, for example whether print material has been ejected from a selected nozzle 312.

In this example, the processor 318 receives data gathered by the drop detector 304 and uses this data to determine if agent is actually ejected from a selected nozzle 312 as intended, and thereby can determine a performance indication for the printhead 302.

In some examples, a drop detector 304 may be moveably mounted so that it can be repositioned to monitor different nozzles 312.

Although in the illustrated example, four units 306 are shown, there may be more or fewer units 306. In one example, there are twelve units 306.

In some examples, the print apparatus 300 may comprise additional components, such as motors, fluid ejection mechanisms and the like.

In the example above, light intensity is detected. Other examples may use other technologies such as detecting changes in refractive index, inductive electrification, humidification and the like.

Figure 4:
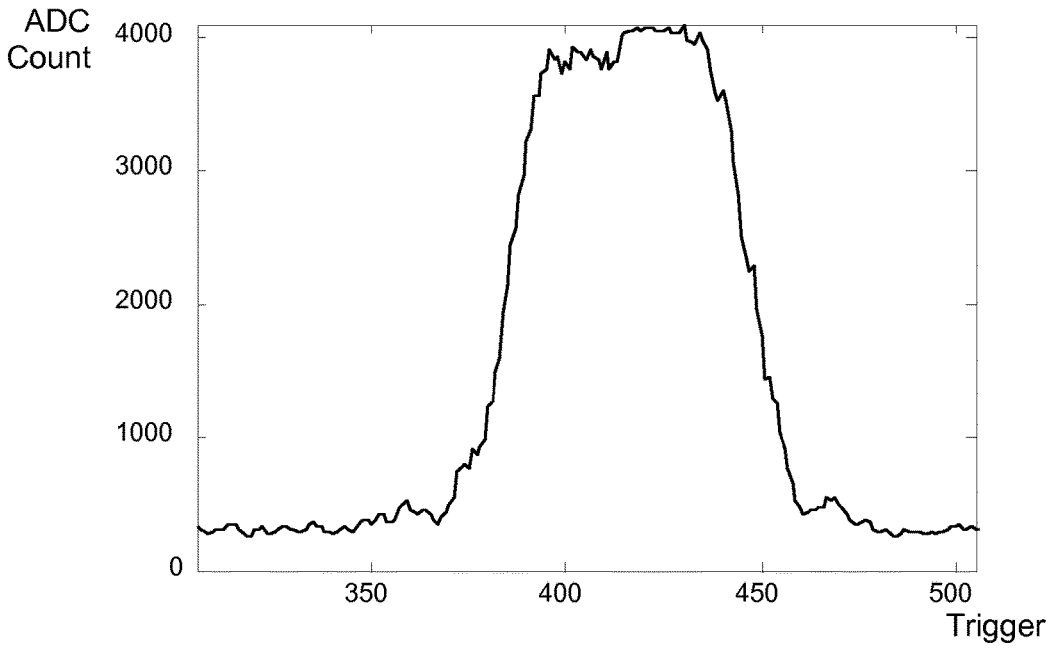
FIG. 4 is a graph showing data gathered by a drop detector in an example.

FIG. 4 shows an example of the count output of an Analogue to Digital converter (ADC) associated with a drop detector where the drop falls relatively close to an emitter and obscures the whole beam, providing a sensor signal profile. If the drop was to obscure just part of a beam, the peak height (and/or the variability of the signal) would be reduced, and the detection task correspondingly harder.

The term 'processor' is to be interpreted broadly to include a CPU, processing unit, ASIC, logic unit, or programmable gate array etc. The methods and functional modules may all be performed by a single processor or divided amongst several processors.

While the apparatus and related aspects have been described with reference to certain examples, various modifications, changes, omissions, and substitutions can be made without departing from the spirit of the present disclosure. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

Features discussed in relation to one example may replace, or be replaced by, features from another example.

The features of any dependent claim may be combined with the features of any of the independent claims or other dependent claims.

The invention claimed is:

1. A printhead drop detector comprising:

a first drop detection unit including a first radiation source and a first radiation detector, wherein the first drop detection unit is to detect a drop passing therethrough;

a second drop detection unit including a second radiation source and a second radiation detector, wherein the second drop detection unit is to detect the drop passing therethrough, and wherein the first radiation source, the second radiation source, the first radiation detector, and the second radiation detector define a sampling volume, wherein the first radiation detector and the second radiation source are arranged on a first side of the sampling volume; and the first radiation source and the second radiation detector are arranged on a second side of the sampling volume, wherein the second side is opposite the first side.

2. A printhead drop detector according to claim 1 in which a third radiation source of a third drop detection unit is arranged on the first side of the sampling volume; and a third radiation detector of the third drop detection unit is arranged on the second side of the sampling volume, and the first drop detection unit is arranged between the second and third drop detection units.

3. A printhead drop detector according to claim 2 wherein the first radiation detector, the second radiation source, and the third radiation detector are arranged in a first line on the first side, and wherein the first radiation source, the second radiation detector, and the third radiation source are arranged in a first line on the first side.

4. A printhead drop detector according to claim 1 wherein the first drop detection unit and the second drop detection unit are each to detect a drop ejected from a nozzle of a printhead.

5. A printhead drop detector according to claim 1 wherein any one of the first radiation source or the second radiation source is a light emitting diode, and wherein any one of the first radiation detector or the second radiation detector is a photodiode.

6. Print apparatus comprising:

a printhead to selectively deliver a print material; and a drop detector to monitor the ejection of print material from the printhead and comprising a plurality of drop detection units, each drop detection unit comprising an emitter and a receiver and being to detect a drop passing though a sampling volume between the emitter and the receiver, wherein the units are arranged such that, on opposed sides of the sampling volume, emitters and receivers are provided alternately.

7. Print apparatus according to claim 6 in which the printhead comprises a plurality of nozzles, the nozzles being arranged in a first column and a second column, spaced from the first column, wherein the nozzles of the first column are parallel to and offset from the nozzles of the second column.

8. Print apparatus according to claim 7 in which each nozzle is associated with a drop detection unit, an associated nozzle being in the column which is relatively closer to the emitter of the drop detection unit associated therewith than the other column.

9. Print apparatus according to claim 7 in which each nozzle is associated with a drop detection unit, an associated nozzle being positioned relatively closer to the emitter than to the receiver of the drop detection unit.

10. Print apparatus according to claim 6 which comprises a processor to receive data from the detector and to determine a performance indication for the printhead.

11. Print apparatus according to claim 10 in which the printhead comprises a set of nozzles, and the processor is to determine if agent is ejected from a selected nozzle.

12. A drop detector for use with a printhead, the drop detector comprising a first row of a first plurality of alternating radiation emitters and radiation detectors and a second row of a second plurality of alternating radiation emitters and radiation detectors, wherein each emitter of the first row is to emit radiation to be received by a paired radiation detector of the second row, and each emitter is of the second row is to emit radiation to be received by a paired radiation detector of the first row.

13. A drop detector according to claim 12 for use with a printhead comprising two columns of nozzles to eject printing agent, wherein each paired radiation emitter and radiation detector is to detect printing agent ejected from a nozzle associated with that paired radiation emitter and radiation detector, wherein in use of the drop detector with the printhead, a nozzle associated with a paired radiation emitter and radiation detector is within the columns of nozzles which is closer to the associated emitter.

14. A drop detector according to claim 13 in which the first row and the second row are parallel and for use with a printhead having columns of nozzles which are, in use of the drop detector with the printhead, arranged parallel to the first row and the second row.

15. A drop detector according to claim 12 which is for use with an inkjet printhead.

* * * * *